United States Patent [19]

Tamaki et al.

[11] 3,937,194

[45] Feb. 10, 1976

[54] ALARM APPARATUS FOR CIRCULATING EXHAUST GAS FLOW CONTROL DEVICE

[75] Inventors: Sigeo Tamaki; Tomoo Itoh, both of Katsuta, Japan

[73] Assignee: Hitachi, Ltd., Tokyo, Japan

[22] Filed: Feb. 25, 1974

[21] Appl. No.: 445,280

[52] U.S. Cl. ..... 123/119 A; 123/198 D

[51] Int. Cl.[2] ..... F02M 25/06

[58] Field of Search ..... 123/119 A, 198 D; 200/83 A, 153 T; 340/239 R

[56] References Cited

UNITED STATES PATENTS

| | | | |
|---|---|---|---|
| 2,824,919 | 2/1958 | Davis | 200/153 T |
| 3,225,340 | 12/1965 | Koehey | 340/239 R |
| 3,412,223 | 11/1968 | Scad | 200/153 T |
| 3,527,909 | 9/1970 | Torre | 200/83 A |
| 3,779,222 | 12/1973 | Lorenz | 123/119 A |
| 3,794,006 | 2/1974 | Woodward | 123/119 A |

*Primary Examiner*—Wendell E. Burns
*Assistant Examiner*—David D. Reynolds
*Attorney, Agent, or Firm*—Thomas E. Beall, Jr.

[57] ABSTRACT

Alarm apparatus is provided for a recirculating exhaust gas flow control device, which device is employed in an internal combustion engine responsive to the negative pressure induced in the carburetor of the engine for controlling the flow of exhaust gas that is recirculated into the fuel-air mixture to be sucked into the engine; the device has a high pressure chamber in communication with the atmosphere, a low pressure chamber in communication with the engine negative intake pressure, and a diaphragm between the chambers for driving a valve that controls the flow of recirculating exhaust gas. The alarm apparatus employs a diaphragm forming high and low pressure chambers and for driving an actuating rod of a control circuit having an alarm signal lamp. The high pressure chamber of the alarm apparatus communicates with the low pressure chamber of the flow control device, and the low pressure chamber of the alarm apparatus communicates with the low pressure chamber of the flow control device and the engine intake, particularly within the vicinity of the carburetor. In the event that there is damage to the flow control device, admission of atmosphere into the high pressure chamber of the alarm apparatus through the control device drives the rod to actuate the alarm circuit.

9 Claims, 1 Drawing Figure

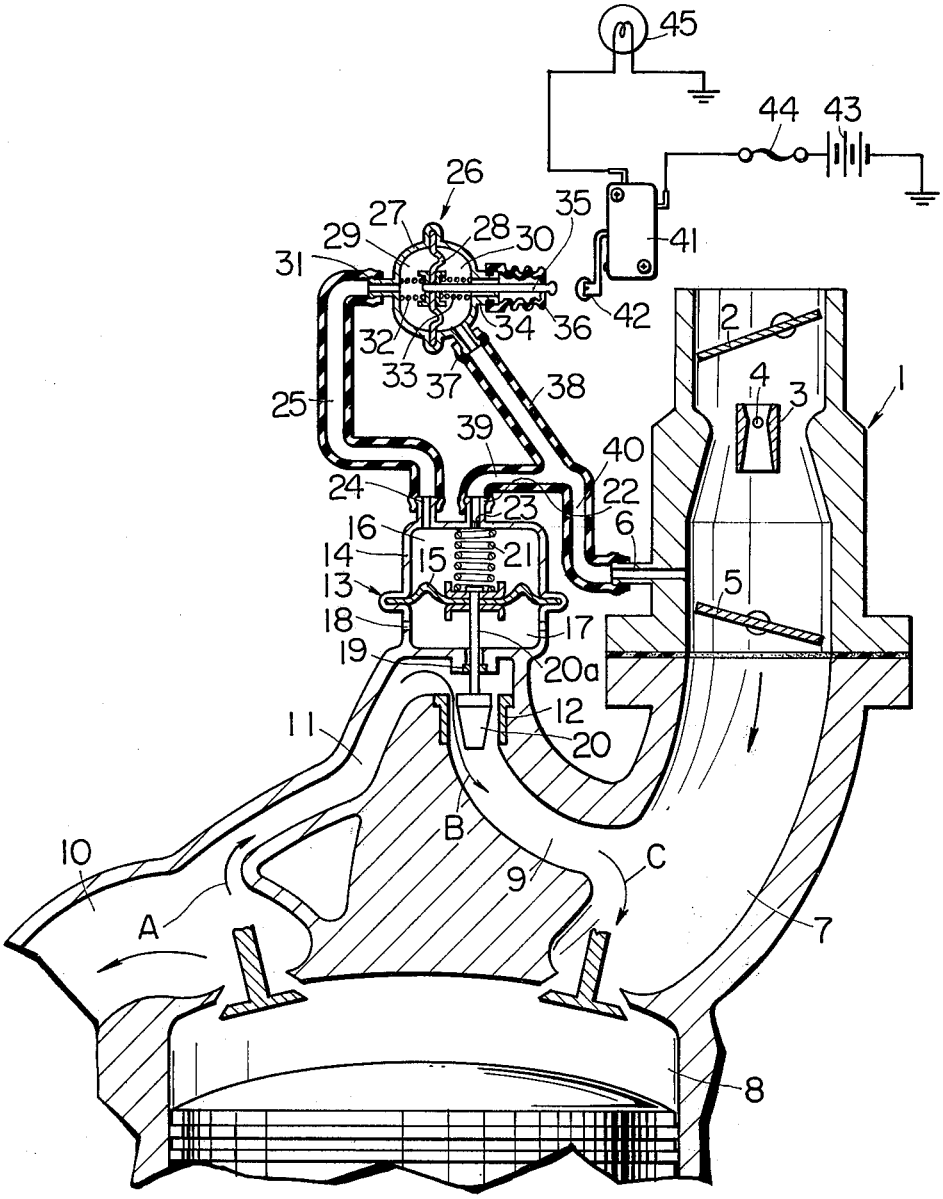
45
44
43
26
27
28
29
30
35
41
31
42
34
36
32
33
37
38
25
39
40
24
22
23
16
6
14
15
21
13
5
18
17
19
20a
12
11
20
B
10
9
C
A
7
8
2
4
3
1

ALARM APPARATUS FOR CIRCULATING EXHAUST GAS FLOW CONTROL DEVICE

BACKGROUND OF THE INVENTION

The present invention relates to an alarm apparatus for a recirculating exhaust gas flow control device, which device is employed in an internal combustion engine to control the quantity of exhaust gas recirculated through the engine, which gas is introduced to the fuel-air mixture to be sucked into the engine.

It is known to purify an exhaust gas from an internal combustion engine, particularly an automobile engine, by recirculating part of the exhaust gas to the fuel-air mixture to be sucked into the engine. The quantity of recirculation of the exhaust gas is controlled by a flow control device in accordance with the pressure in the fuel-air intake system, such as the carburetor provided for the engine.

If the flow control device for recirculating the exhaust gas fails or otherwise develops difficulties, the driver of the automobile may keep on running the engine for a long time without being aware of the trouble that has developed, because the device does not always have a large and direct influence upon the operation of the engine, and this continued operation after trouble has developed will result in failure to purify the exhaust gas. Accordingly, it is desirable to let the driver know that trouble has developed in the device.

SUMMARY OF THE INVENTION

It is an object of the present invention to provide an alarm apparatus for recirculating exhaust gas flow control device employed in an internal combustion engine, which alarm apparatus will provide the driver or operator of the engine with a signal that will indicate that the recirculating exhaust gas flow control device has gotten out of order.

Another object of the present invention is to provide an alarm apparatus for a recirculating exhaust gas flow control device which is simple in its construction, has high reliability, and is easy to be adjusted.

When the device for controlling the quantity of recirculation exhaust gas has gotten out of order, the present invention will produce an alarm by a predetermined movement of a member, which movement is in accordance with a change in the device due to the trouble to be indicated.

BRIEF DESCRIPTION OF THE DRAWING

Further advantages, features and objects of the present invention will become more clear from the following detailed description of a preferred embodiment, as shown in the drawing, wherein the single FIGURE is a cross sectional view of the alarm apparatus, flow control device, and portions of a typical automotive engine.

DETAILED DESCRIPTION OF THE PREFERRED EMBODIMENT

Referring to the accompanying FIGURE, an embodiment of the alarm apparatus for a recirculating exhaust flow control device, according to the present invention, will be described hereinafter. The fuel-air induction system for the engine is specifically shown as a carburetor provided with a choke valve 2, a Venturi 3, a fuel inlet 4, and a throttle valve 5; fuel injection may also be employed. The carburetor 1 is fluid connected, in a conventional manner, with an intake pipe or manifold 7 so that the induction passage of the carburetor 1 communicates with the induction passage of the intake manifold 7. The manifold 7 is connected to the suction or inlet portion of an internal combustion engine, such as an automobile engine 8. Exhaust from the combustion chamber normally passes through the exhaust pipe 10. Passages 9 and 11 are recirculation passages for introducing part of the exhaust gas from the engine 8 back into the induction passage 7 downstream from the throttle valve 5. The quantity of this recirculated exhaust gas in the circulation passage 9, 11 is controlled by a flow control device 13.

The flow control device 13 comprises a housing 14, a diaphragm 15 fixed to the housing 14 about its periphery and dividing the housing 14 into two separate chambers, that is a high pressure chamber 17 communicating with atmosphere through holes 18 provided in the sides of the housing 14 and a low pressure chamber 16 having fluid connectors 22, 24 projecting outwardly, a spring 21 for exerting a downward force on the diaphragm 15, a needle valve 20 connected to the diaphragm 15 through an actuating rod 20a that extends downwardly through a seal 19 provided in the lower portion of the housing 14. The needle valve 21 moves upwardly or downwardly in accordance with movement of the diaphragm 15. The movement of the needle valve 21 controls the quantity of exhaust gas flowing through the exhaust gas recirculation passages 11, 9 in cooperation with a ring 12 with a calibrated opening, which ring 12 is disposed in the exhaust gas recirculation passage. An orifice 23 is provided in the hollow connector 22 so that its internal diameter is substantially smaller than the internal diameter of the flow connector 24.

As a part of the alarm apparatus 26, a rod 35 undergoes a predetermined movement with failure of the flow control device. The alarm apparatus 26 includes a housing 27, a diaphragm fixed to the housing 27 about its periphery and dividing the housing 27 into a high pressure chamber 29 and a low pressure chamber 30, springs 32 and 33 respectively disposed between the housing 27 and the diaphragm 28, and the rod 35 that has one end connected to the diaphragm 28 and the other end projecting out of the housing 27 through a hollow projection 34 which is sealed by means of the bellows 36, which bellows has one end sealingly connected to the projection 34 and the other end sealingly connected to the outer end of the rod 35. The high pressure chamber 29 is provided with a hollow connector 31 telescopically receiving one end of a tube 25 that has its other end telescopically received over the connector 24, so as to provide fluid communication between the low pressure chamber 16 of the flow control device 13 and the high pressure chamber 29 of the alarm apparatus. The low pressure chamber 30 of the alarm apparatus has a hollow connector 37 telescopically receiving one end of a pipe 38, which communicates with a pipe 39 telescopically received on the connector 22 to provide fluid communication between the low pressure chamber 30 of the alarm apparatus and the low pressure chamber 16 of the flow control device. Further, the low pressure chamber 30 fluid communicates with the induction passage of the carburetor 1 in the vicinity of the control valve 5, by means of conduits 38, 40 and a hollow connector provided for the carburetor upstream of the throttle valve 5. Springs 32 and 33 are compression springs that will control movement and positioning of the diaphragm. A microswitch 41 is provided adjacent the actuating rod 35, and has a roller 42 for engagement with the actuating rod 35 upon a predetermined movement of the actuating rod. The microswitch 41 is connected in series with a fuse 44, an electric power source 43, and a signal lamp 45, which constitutes an alarm circuit.

When the engine 8 is running, a negative pressure is induced in the intake passages of the carburetor 1 and in the intake manifold 7. A portion of the exhaust gas A is introduced by the negative pressure through passages 11 and 9 to the point C in the lower portions of the induction passage downstream of the throttle valve 5. The negative pressure is applied to the low pressure chamber 16 of the flow control device 13 through the hollow projection 6, conduits 39, 40, and the orifice 23. As the pressure in the high pressure chamber 17 is that of the atmosphere, it is substantially constant. A vertical movement of the diaphragm 15 or the needle valve 20 will be in accordance with a change in the negative pressure induced in the carburetor 1.

In the event that atmospheric pressure is applied to the low pressure chamber 16, which may result when the diaphragm 15 becomes broken or badly attached to the housing 14, the flow control device 13 cannot satisfactorily control the quantity of exhaust gas recirculated in accordance with pressure in the intake passages of the carburetor 1. In such a case, the diaphragm alarm apparatus of the present invention will detect this damage occurring within the flow control device. The atmospheric pressure that is admitted into the low pressure chamber 16 of the flow control device is also applied to the high pressure side of the diaphragm 28, that is chamber 29, of the alarm apparatus 26 through the conduit 25; at the same time, this atmospheric pressure that has been admitted to the chamber 16 will pass through the orifice 23. However, the air that passes through orifice 23 as the result of atmospheric pressure being applied to chamber 16 is very small and has the effect of producing a very small pressure rise within the low pressure chamber 30 of the alarm apparatus 26, because of the restricting flow of the orifice 23 and the influence of the negative pressure within the intake passages communicating through connector 6 and conduit 40. Therefore, the balance between the forces applied to the opposite sides of the diaphragm 28 is broken, and as the result, the rod 35 is moved toward the right by a predetermined distance, which is enough to engage the actuator 42 of the microswitch 41 and close the alarm circuit.

The driver or operator of the engine 8 will know that there has been damage to the flow control device 13, because of the visual signal produced by the lamp 45. Accordingly, the driver is warned so that he will not further run the engine and disperse exhaust gas unpurified into the atmosphere.

While a preferred embodiment of the present invention has been shown in details, further embodiments, variations and modifications are contemplated within the broader aspects of the present invention, all as determined by the spirit and scope of the following claims.

What is claimed is:

1. An alarm apparatus for a recirculating exhaust gas flow control device, which device is employed in a combustion engine and has an expansible chamber responsive to the intake combustion air pressure and drivingly connected to a recirculation exhaust gas flow control valve for changing the quantity of exhaust gas recirculated in accordance with the intake combustion air pressure of the engine, which alarm apparatus comprises: a housing; a movable member disposed in said housing for dividing said housing into separate opposed first and second alarm expansible chambers; means fluid communicating each of said first and second alarm expansible chambers with said device expansible chamber; means for producing an alarm signal in response to a predetermined movement of said movable member as produced by a predetermined pressure difference between said alarm expansible chambers.

2. An alarm apparatus as defined in claim 1, wherein said movable member is a flexible diaphragm sealingly secured to said housing and provided with a rod drivingly connected at one end with said flexible diaphragm and drivingly connected at its opposite end with said means for producing an alarm signal.

3. An alarm apparatus as defined in claim 2, further including orifice means for restricting fluid flow and providing fluid communication between said device expansible chamber and both said alarm second expansible chamber and the combustion air intake of the engine; and said orifice means having an effective flow cross section substantially smaller than the effective flow cross section of the fluid communication between said device expansible chamber and said alarm first expansible chamber.

4. An alarm apparatus as defined in claim 3, wherein said means for producing an alarm signal comprises an electric circuit having an electric power source, switch means actuated by said predetermined movement of said movable member, and indicator means for indicating actuation of said switch means; and said opposite end of said rod being disposed immediately adjacent said switch means so as to engage said switch means with said predetermined movement of said rod.

5. An alarm apparatus as defined in claim 4, wherein said indicator means is an electric lamp.

6. An alarm apparatus as defined in claim 5, wherein said device expansible chamber is defined by a housing having a diaphragm therein dividing the housing into a high pressure chamber and said device expansible chamber; means freely communicating the atmospheric pressure to said device high pressure chamber.

7. An alarm apparatus as defined in claim 1, further including orifice means for restricting fluid flow and providing fluid communication between said device expansible chamber and both said alarm second expansible chamber and the combustion air intake of the engine; and said orifice means having an effective flow cross section substantially smaller than the effective flow cross section of the fluid communication between said device expansible chamber and said alarm first expansible chamber.

8. An alarm apparatus as defined in claim 7, wherein said means for producing an alarm signal comprises an electric circuit having an electric power source, switch means actuated by said predetermined movement of said movable member, and indicator means for indicating actuation of said switch means.

9. An alarm apparatus as defined in claim 8, wherein said device expansible chamber is defined by a housing having a diaphragm therein dividing the housing into a high pressure chamber and said device expansible chamber; means freely communicating the atmospheric pressure to said device high pressure chamber.

* * * * *